United States Patent [19]

Schönwald

[11] Patent Number: 4,806,073

[45] Date of Patent: Feb. 21, 1989

[54] DUST STRIPPER FOR USE IN A SIDE-CHANNEL COMPRESSOR

[75] Inventor: Siegfried Schönwald, Bad Neustadt/Saale, Fed. Rep. of Germany

[73] Assignee: Siemens Aktiengesellschaft, Berlin and Munich, Fed. Rep. of Germany

[21] Appl. No.: 151,571

[22] Filed: Feb. 2, 1988

[30] Foreign Application Priority Data

Mar. 18, 1987 [DE] Fed. Rep. of Germany ... 8704066[U]

[51] Int. Cl.[4] ..... F04D 5/00; F04D 29/08

[52] U.S. Cl. ..... 415/53 T; 415/170 R

[58] Field of Search ..... 415/53 T, 170 A, 170 R, 415/198.2, 213 T

[56] References Cited

U.S. PATENT DOCUMENTS

| | | | |
|---|---|---|---|
| 2,468,246 | 4/1949 | Thayer | 415/198.2 X |
| 3,095,820 | 7/1963 | Sanborn | 415/53 T |
| 3,768,920 | 10/1973 | Gerwin | 415/213 T X |
| 4,194,798 | 3/1980 | Schonwald et al. | 308/189 R |
| 4,204,802 | 5/1980 | Schonwald et al. | 415/213 T |

FOREIGN PATENT DOCUMENTS

| | | | |
|---|---|---|---|
| 1406579 | 7/1969 | Fed. Rep. of Germany . | |
| 2035380 | 1/1971 | Fed. Rep. of Germany . | |
| 2244151 | 7/1973 | Fed. Rep. of Germany . | |
| 2244933 | 3/1974 | Fed. Rep. of Germany | 415/213 T |
| 2334478 | 1/1975 | Fed. Rep. of Germany | 415/170 R |
| 2405112 | 8/1975 | Fed. Rep. of Germany | 415/170 R |
| 2738208 | 5/1978 | Fed. Rep. of Germany . | |
| 2713091 | 12/1979 | Fed. Rep. of Germany . | |
| 724800 | 3/1980 | U.S.S.R. | 415/53 T |
| 1262117 | 10/1986 | U.S.S.R. | 415/213 T |

*Primary Examiner*—Robert E. Garrett
*Assistant Examiner*—Joseph M. Pitko
*Attorney, Agent, or Firm*—Kenyon & Kenyon

[57] ABSTRACT

In a side-channel compressor having a rotor rotatably supported in a housing, the improvement wherein at least one dust stripper protrudes into a gap between the housing and a rotor to prevent the accumulation of dust in the gap. Preferably, the dust stripper protrudes into a radial gap between a lateral extension of a blade ring portion of the rotor and a lateral extension of the housing. Additionally, the dust stripper is preferably circumferentially located in the inlet half of the compressor so that the pressure gradient in the compressor assists in the removal of dust stripped by the dust stripper. Additionally, or in the alternative, an axially extending dust stripper may be provided in an axial gap between the housing and a hub portion of the rotor.

6 Claims, 2 Drawing Sheets

DUST STRIPPER FOR USE IN A SIDE-CHANNEL COMPRESSOR

BACKGROUND OF THE INVENTION

The present invention relates to improvements in a sidechannel compressor.

Conventional side-channel compressors, an example of which is shown in the German patent No. 2,713,091, generally comprise at least a housing, a rotor closely mounted within the housing and means for rotatably driving the rotor within the housing. More specifically, the rotor comprises a central hub portion and an outer blade ring which extends laterally beyond at least one side of the hub portion in the axial direction. The housing extends laterally below the at least the one extension of the blade ring so as to define a relatively narrow radial gap between the lateral extension of the blade ring and lateral extension of the housing.

Given the purpose of the compressor, it is obviously advantageous to dimension the radial gap between the blade ring extension and the housing extension as narrowly as possible. However, the present inventor has discovered that the narrow dimension of this radial gap can lead to problems when the side-channel compressor is used in transporting gases loaded with dust. In particular, dust can be deposited and accumulate in the radial gap between the base of the lateral extension of the blade ring and the upper surface of the extension of the housing. The problem is particularly prevalent when a sticky or moist dust is involved. Over time, the radial gap will become completely clogged with dust thereby creating large friction forces which could eventually block the rotor or prevent restarting the rotor after an intermission in the operation.

SUMMARY OF THE INVENTION

The present invention obviates the aforesaid problem in the prior art through the provision of at least one dust stripper radially protruding in the radial gap and extending along essentially the entire width of the radial gap which is defined by the overlap between the lateral extension of the blade ring and the lateral extension of the housing. The dust stripper strips off dust deposited in the laterally extending section of the blade ring and thereby prevents clogging of the radial gap. Moreover, since there is a residual radial gap between the stripper and the laterally extending section of the blade ring (i.e., the stripper does not radially bridge the entire radial gap) the provision of the dust stripper does not result in the creation of any additional friction forces so long as there are no dust deposits. Thus, the friction forces occurring at the stripper are so small that they are reliably overcome by the drive motor.

Further, it has been discovered that by locating the dust stripper proximate the inlet opening of the compressor, the dust separated by the stripper may be transported out of the radial gap. More specifically, it has been discovered that it is advantageous to locate the dust stripper in the inlet half of the side-channel compressor which is defined as the region between the center of the housing (relative to the inlet and outlet openings) and the inlet opening. In this region (i.e, the inlet half of the housing), a relatively low pressure still prevails in the side-channel so that the lost flow stemming from the high-pressure side is sufficiently strong to transport the loosened dust from the radial gap into the side channel. Since the pressure differential increases in a direction from the center of the housing toward the inlet opening, it is particularly advantageous to place the dust stripper as close to the inlet opening as possible.

DETAILED DESCRIPTION OF THE INVENTION

Figure 1:
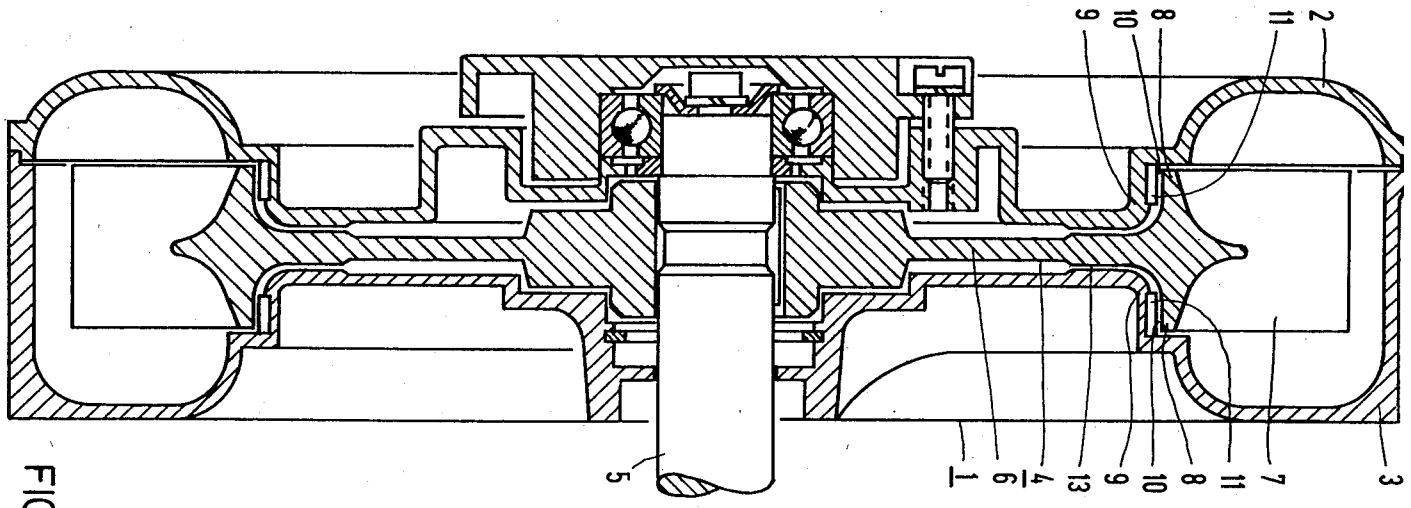
FIG. 1 shows a side-channel compressor in cross section.

FIG. 1 shows a side-channel compressor, the housing of which comprises two housing halves 2 and 3 connected to one another. A rotor 4 is rotatably supported within the housing and is connected to shaft 5 driven by a motor (not shown in the drawing). The rotor 4 consists of a central disk-shaped hub portion 6 and an outer blade ring portion 7 arranged at the 18 outer circumference of the hub portion 6.

Figure 2:
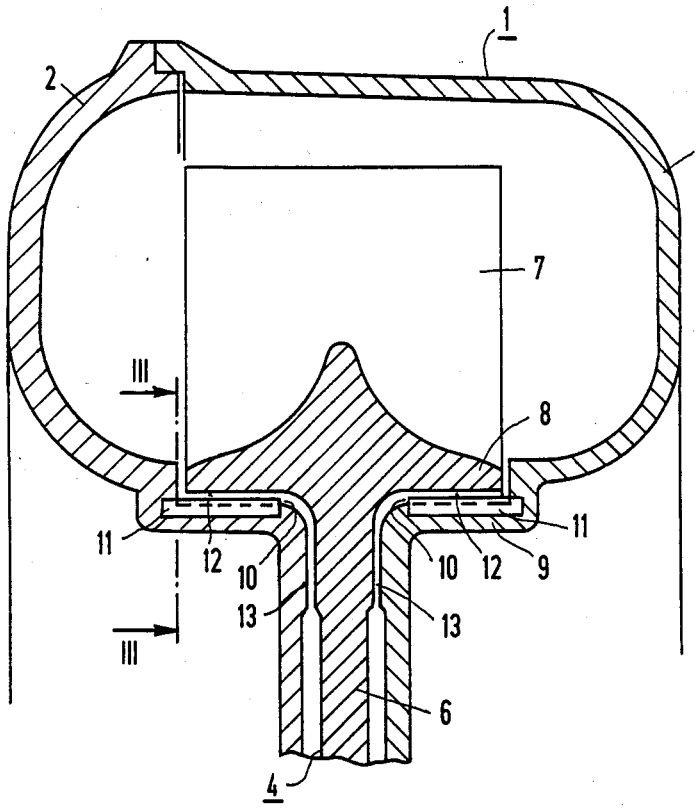
FIG. 2, shows an enlarged view of the arrangement of strippers at the housing of the side-channel compressor.

As is evident from FIGS. 1 and 2, the blade ring portion includes a pair of lateral extensions which extend laterally or axially away from the center of the blade ring such that the blade portion 7 is wider than the hub portion 6 in the direction defined by the axis of rotation of the rotor 4. The two housing halves 2 and 3 are designed in such a manner that they extend beyond the laterally extending sections of the blade ring portions 7. In other words, the housing also includes a pair of lateral extensions which extend radially below the lateral extensions of the blade ring portion 7 to define a narrow radial gap 10. The width of the radial gap 10 is defined by the degree of overlap between the lateral extensions 8 of the blade ring portion 7 and the lateral extensions 9 of the housing halves 2 and 3.

More generally, the dimensions of the housing halves 2 and 3 are chosen with respect to the rotor 4 such that there is a radial gap 10 between the lateral extension or the overhang section 8 and the lateral extension portions of the housing halves 2 and 3 extending under it, and an axial gap 13 between the housing halves and the hub portion 6. The provision of the radial gap 10 and axial gap 13 ensures contact less rotation of the rotor 4 relative to the housing halves 2 and 3.

Figure 3:
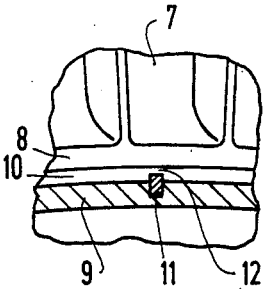
FIG. 3, shows a section along the line III—III in FIG. 2.

In accordance With the present invention, dust strippers 11 are placed on the outer circumferential surfaces of the laterally extending portions 9 of the housing halves 2 and 3. As is evident from FIG. 1–3, the strippers project in the radial direction beyond the outer circumferential contour of the laterally extending portion 9 of the respective housing halves 2 and 3 so as to partially bridge the radial gap 10. However, in order to avoid continuous rubbing of the strippers 11 against the laterally extending portions 8 of the blade ring 7, the radial dimensions of the strippers 11 are chosen so that a residual radial gap 12 remains between the outermost surface of the strippers 11 and the innermost circumferential surface of the lateral extensions 8 of the blade ring 7. As is particularly evident in FIG. 2, the dust strippers 11 extend along substantially the entire width of the radial gap 10 which is defined as the extent of overlap of the lateral extensions 8 of the blade ring 7 and the lateral extensions 9 of the housing halves 2 and 3.

In operation, as the air being compressed flows out as a gap loss via the radial gap 10 and axial gap 13, dust particles contained in the air are transported into these gaps. It has been discovered that deposits of the dust can occur in the radial gap 10 proximate the lateral extensions 8 of the blade ring 7. These deposits are particularly heavy if the dust contained in the air is sticky or moist. Through the provision of dust strippers 11, the dust deposited proximate the lateral extensions 8 of the blade ring 7 is stripped off due to the rotation of the rotor 4 and thus a complete closure of a radial gap 10 is prevented as is a blocking of the rotor 4. Further, as is evident from FIG. 3, the additional friction created by the provision of the dust stripper 11 affects only a small portion of the periphery of the rotor 4. In fact, these friction forces are sufficiently small that they do not lead to a blockage of the rotor 4.

In accordance with another feature of the present invention, it has been discovered that the dust stripper 11 can be located within the compressor so as to take advantage of the pressure gradient created by the compressor to transport the separated dust from the radial gap. More specifically, by arranging the dust stripper 11 in the inlet half of the compressor (i.e., the region between the inlet opening and the point which is half way between the inlet opening and the outlet opening), the dust stripper 11 separates the dust in a region where a higher pressure gradient results in greater loss flow which tends to blow the separated dust from the gap. Since the pressure gradient increases as one moves toward the inlet opening, it is particularly advantageous to locate the dust stripper as close to the inlet opening as possible.

In addition to the above-described embodiment, it is possible to provide dust strippers in the axial gap 13 if dust deposits occur there. Such dust strippers would then extend in a radial direction from the respective housing half 2 or 3. Moreover, since side-channel compressors in which the blade ring portion 7 and hub portion 6 have the same width have only an axial gap between the housing halves and the rotor. Such side-channel compressors, only dust strippers extending in the radial direction may be arranged at the respective housing half.

What is claimed is:

1. In a side-channel compressor comprising:

a rotor and a housing, said rotor being supported in said housing for rotating about an axis, said rotor comprising a central disk shaped hub; and an outer blade ring, said outer blade ring including at least one blade ring portion which is laterally extending, said portion extending beyond said hub in the direction of said axis and said portion having a substantially circumferential radially inner surface;

said housing comprising at least one housing portion which is laterally extending, said housing portion having a substantially circumferential surface extending radially inward of said laterally extending portion of said blade ring such that said laterally extending portion of said blade ring laterally overlaps said housing portion so as to leave a radial gap between the inner surface of the laterally extending portion of the blade ring and the outer surface of the laterally extending portion the housing, the extent of said overlap defining the width of said radial gap;

the improvement comprising at least one dust stripper radially protruding from said circumferential surface of said laterally extending portion of said housing into said radial gap, said dust stripper extending axially along substantially the entire width of the radial gap and extending radially into the radial gap for less than a complete circumference of the housing around said axis.

2. The side-channel compressor of claim 1 wherein said dust stripper has a radially outmost end surface which is located radially inward of the inner surface of the laterally extending portion of said blade ring so as to leave a residual radial gap between the end surface of the dust stripper and the inner surface of the blade ring lateral extension.

3. The side channel compressor of claim 2 wherein said housing further comprises an inlet opening and an outlet opening, said inlet opening and said outlet openings being spaced apart in the circumferential direction of said housing, a circumferential center of said housing defining the circumferential mid-point between said inlet opening and said outlet opening;

wherein said dust stripper protrudes from a region of the housing located between the inlet opening and the circumferential center of the housing.

4. The side-channel compressor of claim 3, wherein said dust stripper is located proximate the inlet opening.

5. The side channel compressor of claim 1 wherein said housing further comprises an inlet opening and an outlet opening, said inlet opening and said outlet opening being spaced apart in the circumferential direction of said housing, a circumferential center of said housing defining the circumferential mid-point between said inlet opening and said outlet opening;

wherein said dust stripper protrudes from a region of the housing located between the inlet opening and the circumferential center of the housing.

6. The side-channel compressor of claim 5, wherein said dust stripper is located proximate the inlet opening.

* * * * *